US005745832A

United States Patent [19]

Yoshiuchi

[11] Patent Number: 5,745,832

[45] Date of Patent: Apr. 28, 1998

[54] IMAGE RECORDING APPARATUS HAVING SPEED CONTROL MEANS

[75] Inventor: Katsuhiro Yoshiuchi, Osaka, Japan

[73] Assignee: Mita Industrial Co., Ltd., Osaka, Japan

[21] Appl. No.: 775,184

[22] Filed: Dec. 30, 1996

[30] Foreign Application Priority Data

Jan. 8, 1996 [JP] Japan ..... 8-001062

[51] Int. Cl.[6] ..... G03G 15/00

[52] U.S. Cl. ..... 399/384; 399/396; 399/400

[58] Field of Search ..... 399/68, 384, 396, 399/381, 388, 394, 400

[56] References Cited

U.S. PATENT DOCUMENTS

| | | | |
|---|---|---|---|
| 4,595,279 | 6/1986 | Kuru et al. | 399/45 |
| 4,943,863 | 7/1990 | Ainoya | 399/384 X |
| 5,187,528 | 2/1993 | Nishikawa et al. | 399/396 X |
| 5,300,995 | 4/1994 | Ohgita et al. | 399/331 |
| 5,373,354 | 12/1994 | Tadokoro et al. | 399/68 X |
| 5,428,431 | 6/1995 | Abe et al. | 399/396 |
| 5,561,512 | 10/1996 | Fukano et al. | 399/68 X |

FOREIGN PATENT DOCUMENTS

| | | |
|---|---|---|
| 0671666A2 | 9/1995 | European Pat. Off. . |
| 0722126A2 | 7/1996 | European Pat. Off. . |
| 0757300A2 | 2/1997 | European Pat. Off. . |
| 03-238486 | 10/1991 | Japan . |
| 04-007564 | 1/1992 | Japan . |
| 05-323844 | 12/1993 | Japan . |
| 06-255850 | 9/1994 | Japan . |

OTHER PUBLICATIONS

*Patent Abstracts of Japan*; Pub. No.: 08157096; Pub. Date: Jun. 18, 1996; Application Date: Nov. 30, 1994; Application No: 06297667; Inventors: Hida Keiji and Shirasaka Kazumi; Title: Sheet Conveying Device for Image Forming Device.

*Patent Abstracts of Japan;* Pub. No.: 08146789; Pub. Date: Jun. 7, 1996; Application Date; Nov. 17, 1994; Application No.: 06283339; Inventors: Masao, et al.; Title: Image Forming Device.

*Patent Abstracts of Japan;* Pub. No.: 63040176; Pub. Date: Feb. 20, 1988; Application Date: Aug. 5, 1986; Application No.: 61183989; Inventor: Yukimachi Hiroshi: Title: Image Forming Device.

*Patent Abstracts of Japan;* Pub. No.: 61034575; Pub. Date: Feb. 18, 1986; Application Date: Jul. 27, 1984; Application No.: 59155493; Inventor: Soga Setsuo; Title: Copying Device.

*Primary Examiner*—Arthur T. Grimley
*Assistant Examiner*—Sophia S. Chen
*Attorney, Agent, or Firm*—Beveridge, DeGrandi, Weilacher & Young, LLP

[57] ABSTRACT

An image recording apparatus according to the present invention has a photosensitive drum, a pre-transfer roller, and a fixing roller. The photosensitive drum, the pre-transfer roller and the fixing roller are generally rotated at an equal peripheral speed. Particularly, the peripheral speed of the photosensitive drum and the peripheral speed of the fixing roller are equal to each other, whereby there is no problem that an image transferred to a rolled-paper sheet from the photosensitive drum extends due to the leading end of the rolled-paper sheet being pulled after reaching the fixing roller. On the other hand, after the leading end of the rolled-paper sheet reaches the fixing roller, the peripheral speed of the pre-transfer roller is so controlled as to be lower than the peripheral speed of the photosensitive drum during a predetermined time period. Suitable tension can be applied to the rolled-paper sheet leading to the fixing roller from the pre-transfer roller by such control as to decrease the peripheral speed of the pre-transfer roller. The rolled-paper sheet is not made slack and is not jammed at the time of conveyance if suitable tension is applied thereto.

12 Claims, 5 Drawing Sheets

IMAGE RECORDING APPARATUS HAVING SPEED CONTROL MEANS

This application is based on application No. 8-1062 filed in Japan, the content of which is incorporated hereinto by reference.

BACKGROUND OF THE INVENTION

1. Field of the Invention

The present invention relates to an image recording apparatus for recording images on paper sheets. Particularly, it relates to an image recording apparatus such as a copying machine capable of copying originals of large size.

2. Description of the Prior Art

A copying machine capable of recording on a paper sheet an original of large size such as AO size in Japanese Industrial Standard (JIS) (hereinafter referred to as "JIS AO size": AO is rectangular and is 1189 mm in length by 841 mm in breadth) has been conventionally provided. FIG. 5 is a conceptual diagram for explaining the form of conveying a paper sheet in such a copying machine.

In a copying machine capable of copying an original of large size, a rolled-paper is generally used as a copying paper sheet which is obtained by winding a strip-shaped paper in a roll shape. The reason why the rolled-paper is used is that an attempt to use previously cut paper sheets of predetermined size presents inconvenience in handling and brings about the necessity of a large-sized paper feeding cassette because the size thereof is large.

Referring to FIG. 5, a rolled-paper 100 is pulled out of a body of rolled-paper 101, and waits in a state where the leading end thereof is sufficiently engaged with a paper feeding roller 102. If a copying operation is started, the paper feeding roller 102 is driven to rotate so that the conveyance thereof is started in a direction indicated by an arrow K. The rolled-paper 100 is led to a photosensitive drum 106 rotated at a predetermined peripheral speed successively through a conveying roller 103, a registration roller 104 and a pre-transfer roller 105.

On the other hand, an electrostatic latent image formed on the basis of optical scanning of the original is developed by toner, so that the toner image is formed on the photosensitive drum 106. The toner image is transferred to the rolled-paper 100 which has reached the photosensitive drum 106 by corona discharges in a transferring corona discharger 107. The rolled-paper 100 to which the toner image has been transferred is heated and pressed by a fixing roller 108 so that the toner is fixed thereto, and is then discharged into the outside of the copying machine by a discharge roller 109.

A cutter mechanism 110 provided between the conveying roller 103 and the registration roller 104 is driven at predetermined timing for cutting the rolled-paper 100 to desired lengths, so that the cut rolled-paper is used as a copying paper sheet described above.

In the above-mentioned copying machine, the peripheral speed of the fixing roller 108 is made higher than the peripheral speed of the photosensitive drum 106. On the other hand, the pre-transfer roller 105 is for smoothly leading the rolled-paper sheet 100 to the photosensitive drum 106, therefore, the peripheral speed thereof is made equal to the peripheral speed of the photosensitive drum 106.

When the rolled-paper sheet 100 has been transferred, the length of which is longer than the distance from the pre-transfer roller 105 to the fixing roller 108, therefore, predetermined tension is exerted on the rolled-paper sheet 100 which has entered the fixing roller 108 by the difference in the peripheral speed between the pre-transfer roller 105 and the fixing roller 108. Accordingly, the rolled-paper sheet 100 is not wrinkled between the photosensitive drum 106 and the fixing roller 108.

When the peripheral speed of the fixing roller 108 is larger than the peripheral speed of the photosensitive drum 106 as described above, however, the conveying speed of the rolled-paper sheet 100 which has entered the fixing roller 108 becomes higher than the peripheral speed of the photosensitive drum 106. Consequently, the equal magnification of a copy image subtly changes, for example, an image recorded on the rolled-paper sheet 100 extends before and after the rolled-paper sheet 100 enters the fixing roller 108.

SUMMARY OF THE INVENTION

An object of the present invention is to solve the above-mentioned technical problems and provide an image recording apparatus in which the equal magnification of an image recorded on a paper sheet does not change.

In a first mode, an image recording apparatus according to the present invention comprises a rotating drum, a pre-transfer roller, and a fixing roller. The rotating drum, the pre-transfer roller and the fixing roller are generally rotated at an equal peripheral speed. Particularly by making the peripheral speed of the rotating drum and the peripheral speed of the fixing roller equal to each other, there arises no problem that the equal magnification of an image changes, for example, an image transferred to a paper sheet extends because the paper sheet is pulled by the fixing roller after the leading end thereof reaches the fixing roller.

Furthermore, in the first mode, the image recording apparatus further has peripheral speed control means for controlling the pre-transfer roller so that the peripheral speed of the pre-transfer roller is lower than the peripheral speed of the rotating drum during a predetermined time period elapsed after the leading end of the paper sheet reaches the fixing roller when the image is recorded on the paper sheet longer than the distance of a conveying path from the pre-transfer roller to the fixing roller. In such a case, therefore, by the peripheral speed control means, the peripheral speed of the pre-transfer roller is made low after the leading end of the paper sheet enters the fixing roller, whereby predetermined tension is applied to the paper sheet in the conveying path leading to the rotating drum and the fixing roller from the pre-transfer roller. Therefore, the paper sheet is not wrinkled, for example. Moreover, the paper sheet is not easily jammed.

In a second mode of the present invention, a predetermined time period during which the peripheral speed of the pre-transfer roller is made low shall be a time period elapsed from the time when the leading end of the paper sheet reaches the fixing roller until the trailing end of the paper sheet reaches a predetermined positional relationship with the pre-transfer roller.

In a third mode of the present invention, the above-mentioned predetermined time period is a time period elapsed until the trailing end of the paper sheet reaches a predetermined position on the upstream side of the pre-transfer roller.

According to the second and third modes, when the trailing end of the paper sheet leaves the pre-transfer roller, the peripheral speed of the pre-transfer roller is made equal to the normal peripheral speed, that is, equal to the peripheral speed of the rotating drum and the fixing roller. Consequently, there is no problem that the tension exerted on the paper sheet is suddenly removed when the trailing end of the paper sheet leaves the pre-transfer roller.

In a fourth mode of the present invention, a fixing switch for detecting that the leading end of the paper sheet reaches the fixing roller is provided in relation to the fixing roller. The peripheral speed of the pre-transfer roller is switched on the basis of a signal of the fixing switch.

In a fifth mode of the present invention, a registration switch is provided on the upstream side of the pre-transfer roller. The peripheral speed of the pre-transfer roller is switched on the basis of an output of the registration switch.

The image recording apparatus generally comprises the fixing switch and the registration switch as indispensable switches. The peripheral speed of the pre-transfer roller can be switched utilizing outputs of the switches. Therefore, the necessity of providing a new switch dedicated to switch the peripheral speed of the pre-transfer roller is eliminated.

In a sixth mode of the present invention, the pre-transfer roller comprises a clutch mechanism causing slip when not less than a predetermined load occurs in the direction of paper conveyance. By the function of the clutch mechanism, slip occurs in the rotation of the pre-transfer roller when the pre-transfer roller having a low peripheral speed pulls the rear part of the paper sheet, whereby more tension than necessary is not applied to the paper sheet.

In a seventh mode of the present invention, the image recording apparatus comprises a plurality of rolled-paper sheets respectively wound around a plurality of feeding reels. Any one of the rolled-paper sheets is selectively delivered to the conveying path.

In an eighth mode of the present invention, a cutter mechanism for cutting the rolled-paper sheet is provided on the upstream side of the pre-transfer roller in the direction of paper conveyance on the conveying path.

Therefore, according to the seventh and eighth modes, a long rolled-paper sheet can be used, whereby image recording, for example, on a lot of paper sheets can be continuously and smoothly made.

In a ninth mode of the present invention, the image recording apparatus is a copying machine comprising a reading mechanism for reading an original, and a mechanism for forming an image of the read original on a photosensitive drum.

In a tenth mode of the present invention, the copying machine comprises a first motor for driving the pre-transfer roller, a second motor for driving the fixing roller, and a speed detector for detecting the rotational speed of the pre-transfer roller in relation to the pre-transfer roller. The rotational speed of the first motor is controlled on the basis of an output of the speed detector.

Furthermore, in an eleventh mode of the present invention, a driving force is applied to the cutter mechanism from the second motor for driving the fixing roller.

A copying machine suitable for copies of large size can be realized by employing such construction.

The foregoing and other objects, features, aspects and advantages of the present invention will become more apparent from the following detailed description of the present invention when taken in conjunction with the accompanying drawings.

DETAILED DESCRIPTION OF THE PREFERRED EMBODIMENTS

Figure 1:
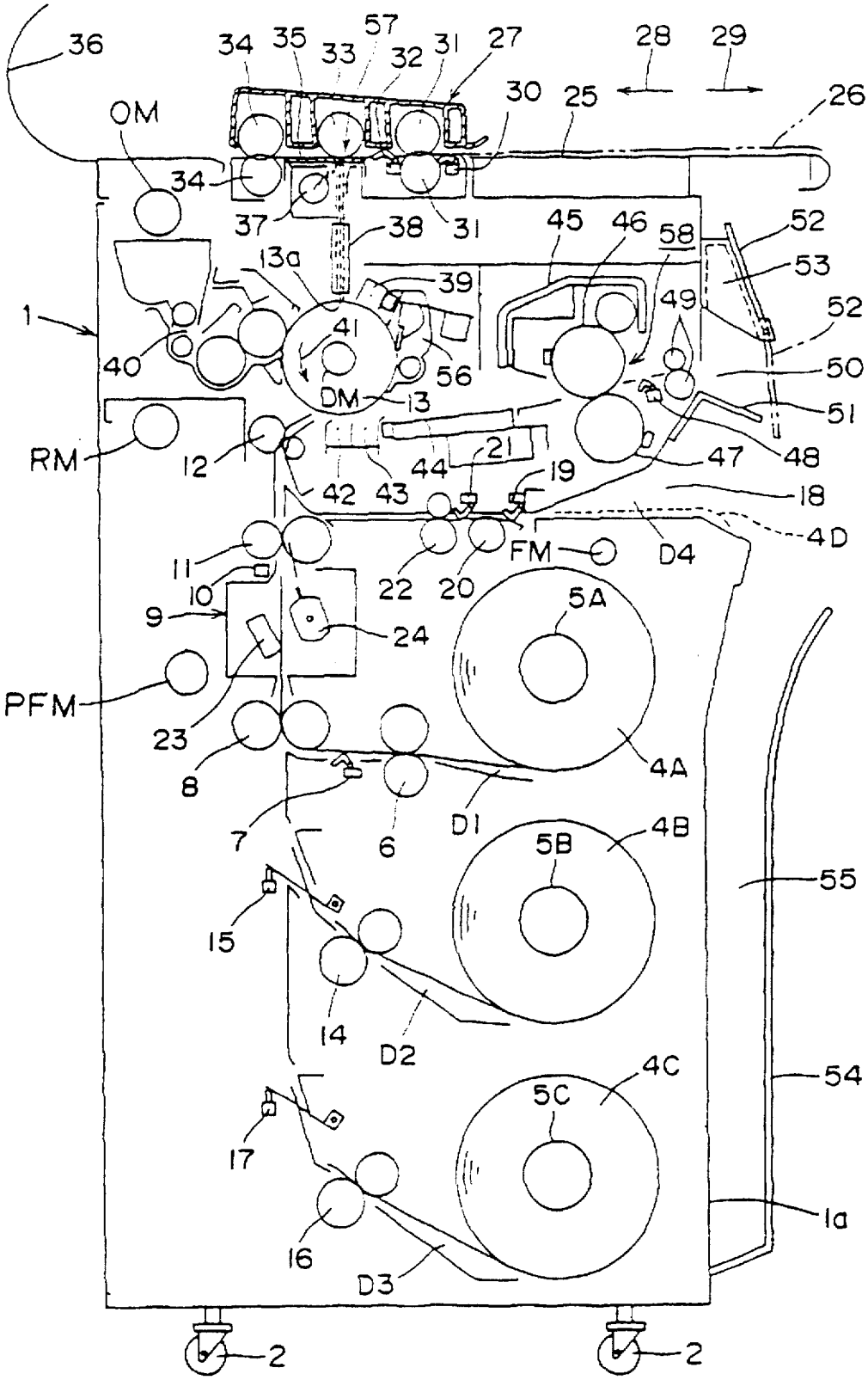
FIG. 1 is a cross-sectional view as viewed from the side schematically showing the internal construction of a copying machine according to one embodiment of the present invention.
Figure 2:
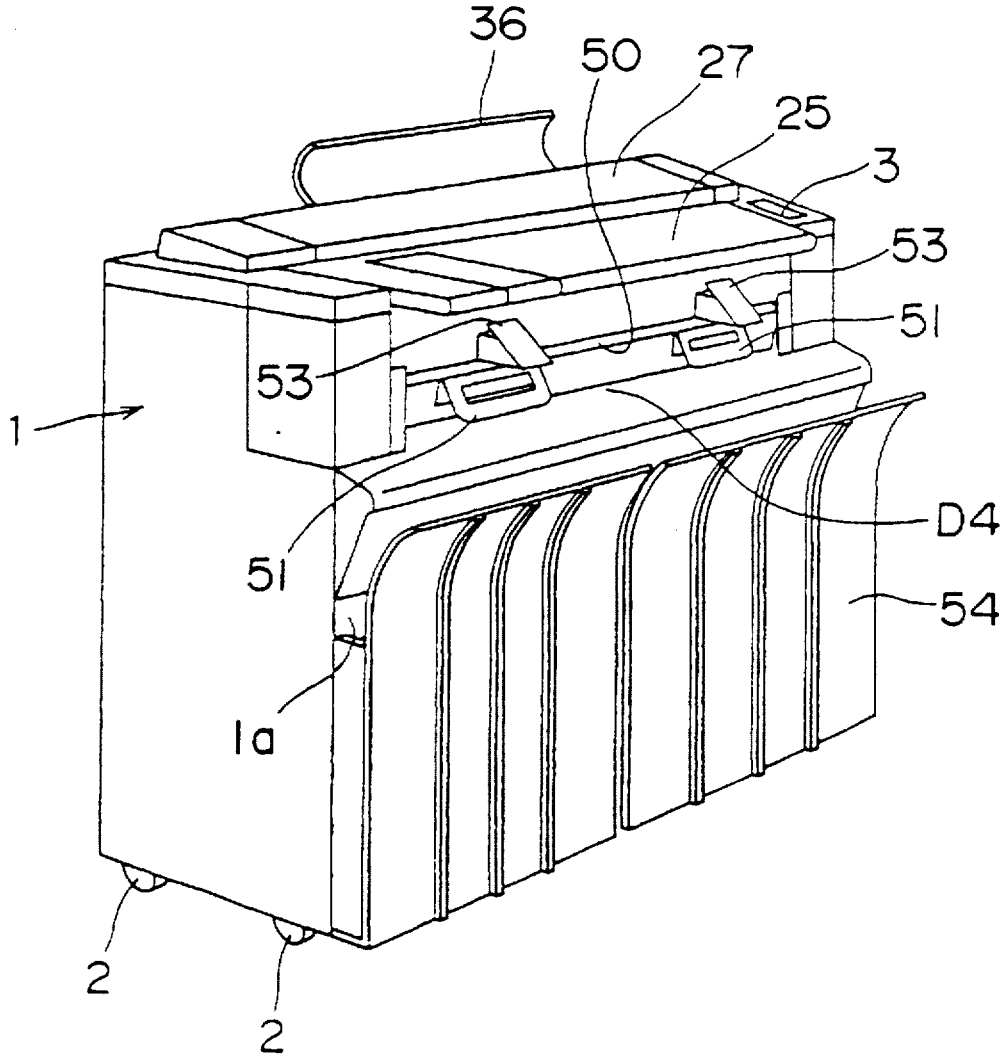
FIG. 2 is a perspective view showing the construction of the appearance of the copying machine.

FIG. 1 is a cross-sectional view as viewed from the side schematically showing the internal construction of a copying machine according to one embodiment of the present invention. FIG. 2 is a perspective view showing the construction of the appearance of the copying machine. The copying machine is for obtaining a copy image of an original of large size such as JIS AO size. In the copying machine, the original is conveyed, while its surface is illuminated and scanned by an optical system fixedly arranged inside the copying machine, whereby an image is formed on the basis of the illumination and scanning.

Referring to FIGS. 1 and 2, caster wheels 2 are mounted on the bottom of a main body 1 of the copying machine, so that the main body 1 of the copying machine is freely movable. An operation section 3 having switches, keys and the like for performing various setting related to copying arranged therein is provided at an end on the upper surface of the main body 1 of the copying machine. Further, an original conveying section 27 as described later is provided in the upper part of the main body 1 of the copying machine.

Rolled-papers 4A, 4B and 4C are contained in three stages, i.e., upper, intermediate and lower stages, for example, in a portion below the center along the height of the main body 1 of the copying machine. The rolled-papers 4A, 4B and 4C are respectively wound around feeding reels 5A, 5B and 5C. Examples of the rolled-papers 4A, 4B and 4C include plain paper, a film, and tracing paper. At the time of a copying operation, the rolled-paper 4A, 4B or 4C is delivered onto a conveying path depending on the type previously set by a user.

A paper feeding roller 6 is disposed in the vicinity of the rolled-paper 4A in the upper stage, and the rolled-paper 4A waits in a state where its leading end is sufficiently engaged with the paper feeding roller 6. The paper feeding roller 6 is driven to rotate, so that the conveyance of the rolled-paper 4A is started. Thereafter, the rolled-paper 4A is conveyed along a first conveying path D1 leading to a photosensitive drum 13 successively through a first paper feeding switch 7 for detecting the leading end of the rolled-paper 4A, a conveying roller 8, a cutter mechanism 9, a registration switch 10, a registration roller 11, and a pre-transfer roller 12.

A paper feeding roller 14 is disposed in the vicinity of the rolled-paper 4B in the intermediate stage, and the rolled-paper 4B waits in a state where its leading end is sufficiently engaged with the paper feeding roller 14. The paper feeding roller 14 is driven to rotate, so that the conveyance of the rolled-paper 4B is started. Thereafter, the rolled-paper 4B is conveyed along a second conveying path D2 leading to the photosensitive drum 13 successively through a second paper feeding switch 15 for detecting the leading end of the rolled-paper 4B, the conveying roller 8, the cutter mechanism 9, the registration switch 10, the registration roller 11, and the pre-transfer roller 12. The path succeeding the conveying roller 8 is common to the first conveying path D1.

A paper feeding roller 16 is disposed in the vicinity of the rolled-paper 4C in the lower stage, and the rolled-paper 4C waits in a state where its leading end is sufficiently engaged with the paper feeding roller 16. The paper feeding roller 16 is driven to rotate, so that the conveyance of the rolled-paper 4C is started. Thereafter, the rolled-paper 4C is conveyed along a third conveying path D3 leading to the photosensitive drum 13 successively through a third paper feeding switch 17 for detecting the leading end of the rolled-paper 4C, the conveying roller 8, the cutter mechanism 9, the registration switch 10, the registration roller 11, and the pre-transfer roller 12. The path succeeding the conveying roller 8 is common to the first conveying path D1.

The registration switch 10 is a switch so adapted as to be turned on when the rolled-paper 4A, 4B or 4C exists in the position of the registration roller 11, while being turned off if it does not exist therein, and is located in the vicinity of the registration roller 11.

Furthermore, a manual paper feeding section 18 for introducing a previously cut paper sheet 4D of size such as AO size to A4 size into the main body of the copying machine is formed in a predetermined position on a front surface 1*a* of the main body 1 of the copying machine. The cut paper sheet 4D introduced from the manual paper feeding section 18 is conveyed along a bypass conveying path D4 leading to the photosensitive drum 13 successively through a fourth paper feeding switch 19 for detecting the leading end of the cut paper sheet 4D, a separating roller 20 for separating the cut paper sheets one by one, a registration switch 21, a registration roller 22, and the pre-transfer roller 12. The path succeeding the pre-transfer roller 12 is common to the first conveying path D1. In the following description, the rolled-paper 4A, 4B or 4C shall be used as a paper sheet on which a copy image is recorded. Description in a case where the cut paper sheet 4D is used will be omitted.

The cutter mechanism 9 comprises a longitudinal fixed blade 23 extending in a direction perpendicular to the direction of conveyance of the rolled-paper 4A, 4B or 4C and a rotating blade 24. In the cutter mechanism 9, the rotating blade 24 is driven at predetermined timing, so that the rolled-paper 4A, 4B or 4C is cut to desired length as a copying paper sheet.

Furthermore, the original conveying section 27 for conveying an original 26 along an original conveying path 25 formed on the upper surface of the main body 1 of the copying machine is provided in the upper part of the main body 1 of the copying machine. The original conveying section 27 switches the direction of conveyance between a forward direction indicated by an arrow 28 and a reverse direction indicated by an arrow 29, to convey the original 26. The original conveying path 25, being on the upstream side compared with the original conveying section 27 with respect to the forward direction 28 of conveyance, is formed to a position where it protrudes from the upper surface of the main body 1 of the copying machine. The original 26 is set in this position with the bottom up.

In the original conveying section 27, a first original end detecting switch 30 for detecting the leading end of the set original 26, a first original conveying roller 31, a second original end detecting switch 32, a second original conveying roller 33 and a third original conveying roller 34 are successively disposed in the forward direction 28.

When the first original end detecting switch 30 is switched from its off state to its on state due to the existence of the original 26, the first original conveying roller 31 is driven to rotate, whereby the original 26 is led to a transparent plate 35 provided in a predetermined position on the upper surface of the main body 1 of the copying machine in the original conveying section 27. The original 26 is subjected to slit exposure in a predetermined position 57 on the transparent plate 35 upon being made to adhere to the transparent plate 35 by the second original conveying roller 33 located in a position opposite to the transparent plate 35. The exposure is made when the original 26 is conveyed in the forward direction 28, while not being made when it is conveyed in the reverse direction 29. The original 26 after the exposure is discharged from the original conveying section 27 by the third original conveying roller 34.

A reversing member 36 is attached to an end of the original conveying path 25 on the downstream side in the forward direction 28 of conveyance, whereby the original 26 discharged from the original conveying section 27 is prevented from dropping into the back of the main body 1 of the copying machine.

The second original end detecting switch 32 is switched from its off state to its on state when the original 26 is conveyed in the forward direction 28, to detect the leading end of the original 26. The conveyance of the rolled-paper 4A, 4B or 4C (the rolled-paper 4A, 4B or 4C conveyed for copying is hereinafter merely referred to as "the rolled-paper sheet 4") is started in response to the turning-on of the second original end detecting switch 32. Consequently, the conveyance of the original 26 and the conveyance of the rolled-paper sheet 4 are synchronized with each other.

Furthermore, the second original end detecting switch 32 is switched from its on state to its off state when the original 26 is conveyed in the reverse direction 29, to detect the trailing end of the original 26 conveyed in the reverse direction 29. The driving of each of the original conveying rollers 31, 33 and 34 is stopped in response to the turning-off of the second original end detecting switch 32. At this time, there occurs a state where an end on the upstream side in the forward direction 28 of the original 26 is held by the first original conveying roller 31, to prepare for the subsequent copying operation.

In the present embodiment, the length of a conveying path of the rolled-paper sheet 4 leading to a transferring corona discharger 42 as described later from the cutter mechanism 9 is set to a length longer than the length of an original conveying path leading to the position for original exposure 57 from the first original end detecting switch 30 by a length leading to the position of the transferring corona discharger 42 from a position for exposure 13*a* of the photosensitive drum 13. Consequently, an image corresponding to the trailing end of the original 26 can be formed at the trailing end of the rolled-paper sheet 4 cut at predetermined timing.

A light source 37 is fixedly arranged in relation to the transparent plate 35. An original surface of the original 26 conveyed to the position for original exposure 57 is illuminated through the transparent plate 35 by light from the light source 37. Light reflected from the surface of the original 26 is directed to the surface of the photosensitive drum 13 provided at an approximately central part of the main body 1 of the copying machine by a Selfoc lens 38. The surface of the photosensitive drum 13 before being exposed by the light from the Selfoc lens 38 is uniformly changed by a charging corona discharger 39. Therefore, an electrostatic latent image corresponding to the original image is formed on the surface of the photosensitive drum 13 after being exposed. The electrostatic latent image is developed into a toner image by a developing device 40. The toner image is moved to the vicinity of the transferring corona discharger 42 by the rotation of the photosensitive drum 13 in a direction indicated by an arrow 41.

As described in the foregoing, the rolled-paper sheet 4 whose conveyance is started in response to the turning-on of the second original end detecting switch 32 is stopped once by the registration roller 11, after which the conveyance is resumed at timing at which the toner image formed on the surface of the photosensitive drum 13 and the rolled-paper sheet 4 are opposite to each other in the position of the transferring corona discharger 42. The rolled-paper sheet 4 is led to the vicinity of the transferring corona discharger 42 in a state where it is in contact with the surface of the photosensitive drum 13, whereby the toner image on the surface of the photosensitive drum 13 is transferred onto the rolled-paper sheet 4 by corona discharges in the transferring corona discharger 42. The rolled-paper sheet 4 to which the toner image has been transferred is stripped from the surface of the photosensitive drum 13 by corona discharges in a separating corona discharger 43, and is further led to a fixing device 45 through a conveying path 44.

The fixing device 45 comprises a fixing roller 58 comprising a heat roller 46 and a pressure roller 47. The rolled-paper sheet 4 led to the fixing device 45 enters a portion between the heat roller 46 and the pressure roller 47, and is heated by the heat roller 46, starting at its leading end portion, and is simultaneously pressed by the pressure roller 47, whereby toner is fixed to the surface of the rolled-paper sheet 4.

A fixing switch 48 for detecting whether or not the rolled-paper sheet 4 reaches the fixing roller 58 is provided in a predetermined position on the downstream side of the fixing roller 58 in the direction of conveyance of the rolled-paper sheet 4. In the present embodiment, when the rolled-paper sheet 4 is sufficiently engaged with the fixing roller 58 so that peripheral speed control as described later is started after the rolled-paper sheet 4 reliably reaches the fixing roller 58, the fixing switch 48 is switched from its off state to its on state. However, the fixing switch 48 may be provided in the vicinity of the fixing roller 58 and turned on the instant the leading end of the rolled-paper sheet 4 enters the fixing roller 58.

The rolled-paper sheet 4 to which the toner is fixed by the fixing device 45 is discharged into the outside of the main body 1 of the copying machine from a discharge port 50 by a discharge roller 49. On the other hand, the toner remaining on the surface of the photosensitive drum 13 after the toner image has been transferred is removed by a cleaning device 56, to prepare for the subsequent image formation.

A guiding member 51 and a guide assisting plate 52 are mounted in relation to the discharge port 50. The rolled-paper sheet 4 discharged from the discharge port 50 is guided to a pocket 55 formed by a front cover 54 mounted along the front surface 1*a* of the main body 1 of the copying machine. The guide assisting plate 52 is rotatably supported by a stay 53 mounted on the front surface 1*a* of the main body 1 of the copying machine, and is displaceable between a guiding position where the rolled-paper sheet 4 discharged, hanging down ahead of the guiding member 51, is guided to a pocket 55 in cooperation with the guiding member 51 (indicated by a one dot and dash line in FIG. 1) and a containing position where the rolled-paper sheet 4 is held in the stay 53 (indicated by a solid line in FIG. 1).

The copying machine comprises a drum motor DM for driving the photosensitive drum 13, a pre-transfer roller motor RM for driving the pre-transfer roller 12, the developing device 40 and the like, a paper feeding motor PFM for driving a group of rollers (excluding the pre-transfer roller 12) for feeding the rolled-paper sheet 4 and the cut paper sheet 4D, a fixing motor FM for driving the heat roller 46, the pressure roller 47 and the like in the fixing device 45, and an original conveying motor OM for driving the original conveying section 27.

Figure 3:
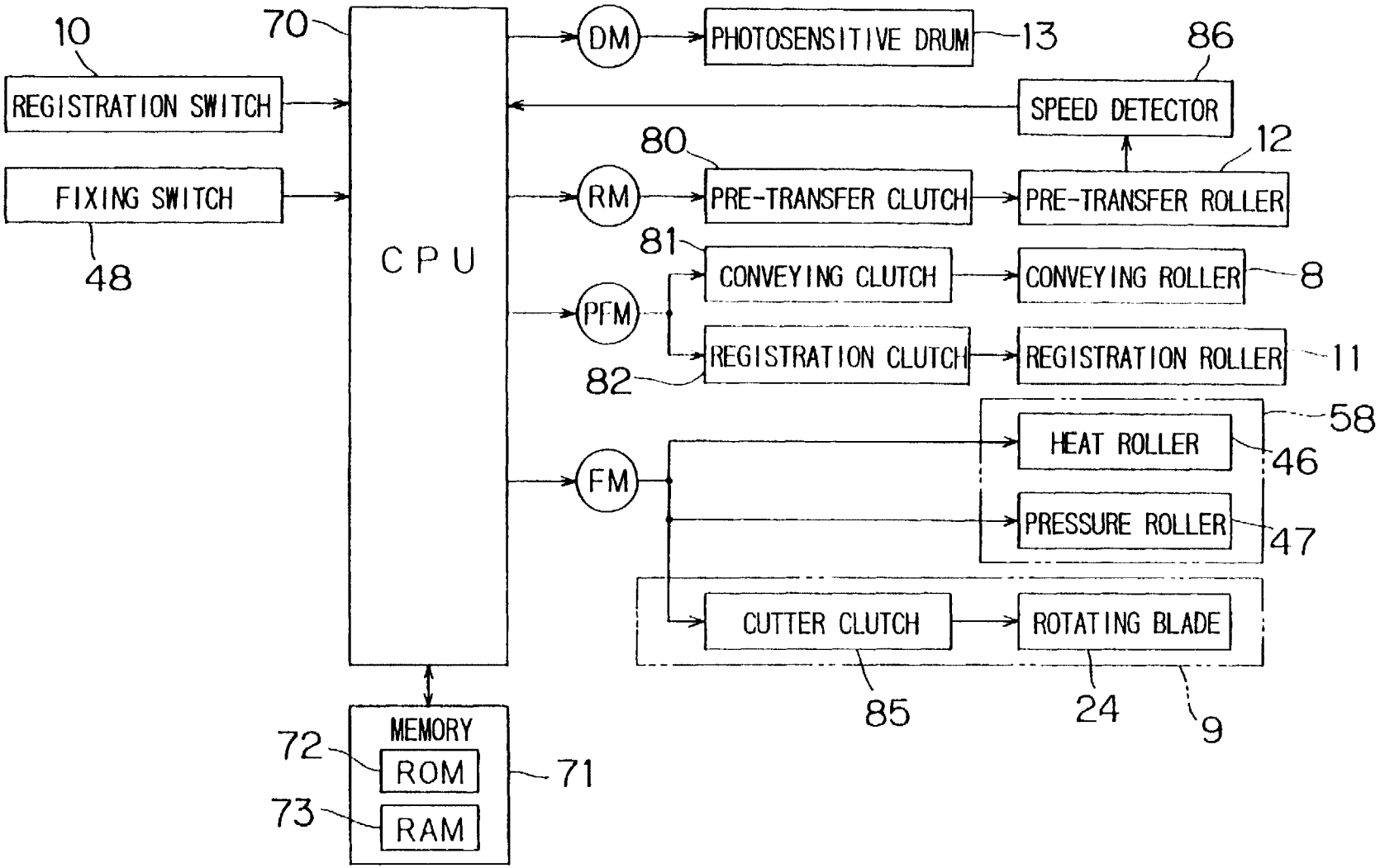
FIG. 3 is a block diagram showing the electrical construction of the copying machine.

FIG. 3 is a block diagram showing the construction of a control circuit for carrying out peripheral speed control which characterizes the copying machine according to the present embodiment. In the peripheral speed control, the peripheral speed of the pre-transfer roller 12 is so controlled that the equal magnification of an image transferred to the rolled-paper sheet 4 does not change.

Specifically, in the normal control, the peripheral speed of the photosensitive drum 13 and the peripheral speed of the fixing roller 58 are made equal to each other. Further, the peripheral speed of the pre-transfer roller 12 is also made equal to the peripheral speed of the photosensitive drum 13. Consequently, the rolled-paper sheet 4 is smoothly conveyed without being made slack and pulled because the peripheral speeds of the two rollers and the one drum are equal while the rolled-paper sheet 4 is sent to the photosensitive drum 13 from the pre-transfer roller 12, and is further conveyed by the fixing roller 58.

Furthermore, when the rolled-paper sheet 4 to be conveyed is long, that is, the rolled-paper sheet 4 is longer than the distance of the conveying path from the position of the pre-transfer roller 12 to the fixing roller 58, the leading end of the rolled-paper sheet 4 enters the fixing roller 58, after which the peripheral speed of the pre-transfer roller 12 is made low during a predetermined time period. Consequently, suitable tension can be applied to the rolled-paper sheet 4 leading to the fixing roller 58 from the pre-transfer roller 12, whereby the rolled-paper sheet 4 can be satisfactorily conveyed in a state where the rolled-paper sheet 4 is not made slack and is not jammed, for example.

Referring to FIG. 3, the control circuit comprises a CPU 70 serving as a control center. A memory 71 including a ROM 72 and a RAM 73 is connected to the CPU 70. The CPU 70 carries out control of various sections in accordance with programs stored in the ROM 72.

An on/off signal outputted from the registration switch 10, an on/off signal outputted from the fixing switch 48, and a signal from a speed detector 86 as described later are inputted to the CPU 70. The CPU 70 controls the driving of rotation of the pre-transfer roller 12, the photosensitive drum 13, the conveying roller 8, the registration roller 11, the fixing roller 58 comprising the heat roller 46 and the pressure roller 47, and the rotating blade 24 in the cutter mechanism 9.

More specifically, the pre-transfer roller 12 is connected to the CPU 70 through the pre-transfer roller motor RM and a pre-transfer clutch 80. The pre-transfer clutch 80 is a one-way clutch mounted on a driving shaft which should transmit a driving force of the pre-transfer roller motor RM to the pre-transfer roller 12 to transmit the driving force in only one direction and so adapted that slip occurs in the direction in a frictional portion in its inside when not less than a predetermined load occurs. Further, there is provided a speed detector 86 for detecting the rotational speed of the pre-transfer roller 12 in relation to the pre-transfer roller 12. The speed detector 86 is for, for example, outputting a pulse signal in a period corresponding to the number of rotations of the pre-transfer roller 12.

The CPU 70 controls on/off of the pre-transfer clutch 80, so that a driving force of the pre-transfer roller motor RM is transmitted to/disconnected from the pre-transfer roller 12. Further, the CPU 70 refers to a pulse signal outputted from the speed detector 86, to control the driving force of the pre-transfer roller motor RM. Specifically, when the peripheral speed control is carried out, the driving force of the pre-transfer roller motor RM is so changed that the peripheral speed of the pre-transfer roller 12 after the entrance of the rolled-paper sheet 4 into the fixing roller 58 becomes lower than the peripheral speed of the photosensitive drum 13.

Furthermore, the rotation of the photosensitive drum 13 is controlled by on/off control of the drum motor DM. The control of the rotation of the conveying roller 8 and the registration roller 11 is carried out by on/off control of the conveying clutch 81 and the registration clutch 82 respectively mounted in driving shafts which should transmit a driving force of the paper feeding motor PFM to the conveying roller 8 and the registration roller 11 during the paper feeding motor PFM is turned on.

Additionally, the heat roller 46 and the pressure roller 47 are rotated by the fixing motor FM.

The rotating blade 24 is driven at predetermined timing by on/off control of the cutter clutch 85 mounted in a driving shaft which should transmit a driving force of the fixing motor FM to the rotating blade 24 when the fixing motor FM is in its on state.

Figure 4:
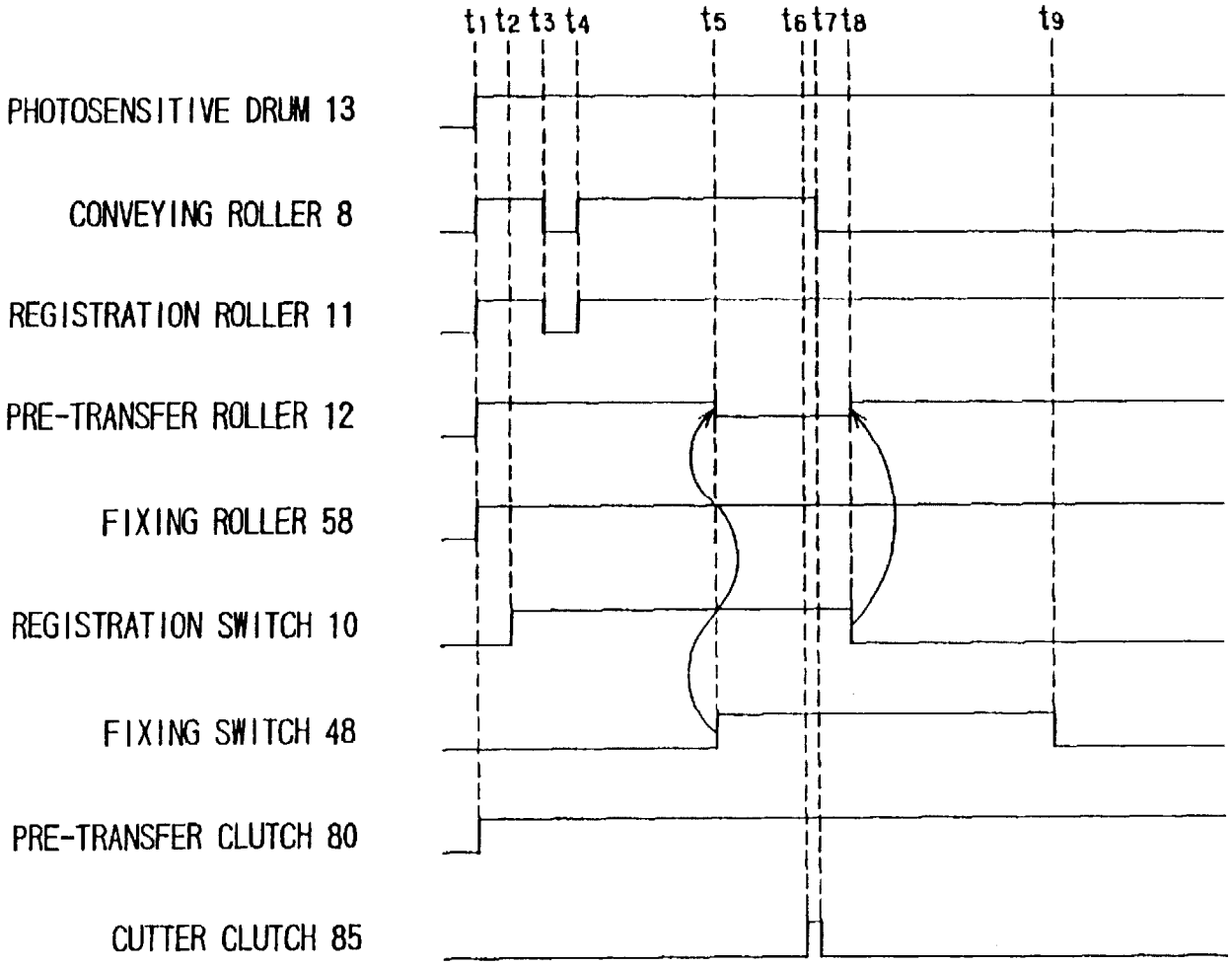
FIG. 4 is a timing chart showing the timing of operations for peripheral speed control.
Figure 5:
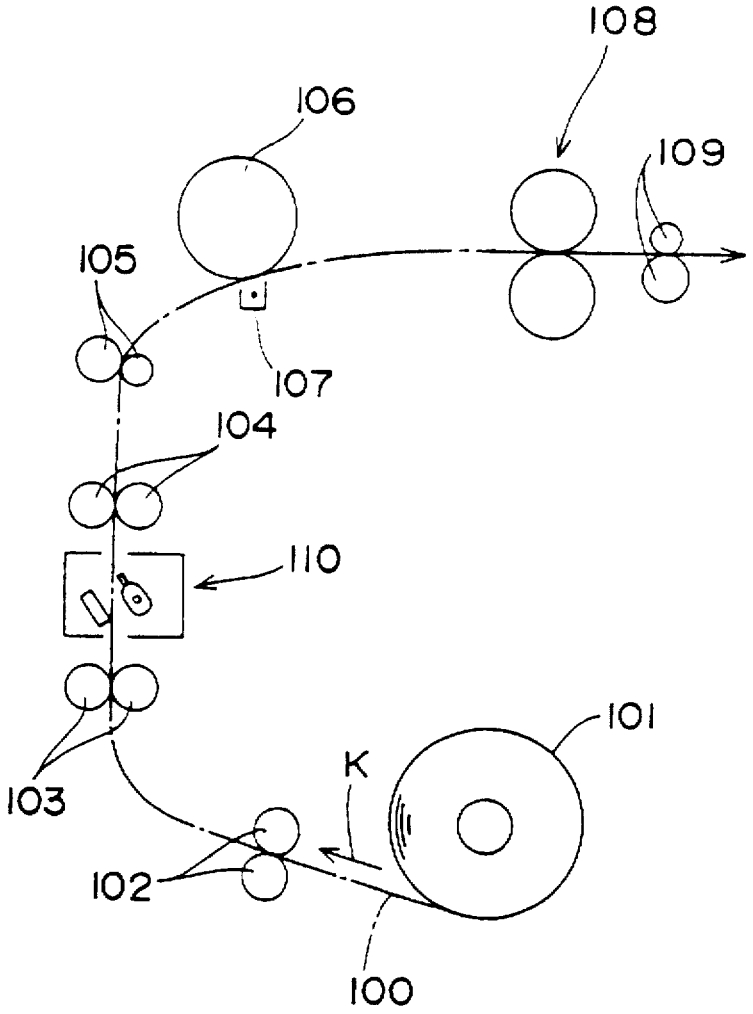
FIG. 5 PRIOR ART
FIG. 5 is a conceptual diagram for explaining the form of conveying a paper sheet.

FIG. 4 is a diagram showing the timing of operations for peripheral speed control carried out by the CPU 70.

The CPU 70 turns the drum motor DM on, to start the rotation of the photosensitive drum 13 ($t_1$) in response to the change of the second original end detecting switch 32 from its off state to its on state upon start of the conveyance of the original 26 in the original conveying section 27. At the same time, the paper feeding motor PFM, the conveying clutch 81 and the registration clutch 82 are turned on, so that the conveying roller 8 and the registration roller 11 are driven. Consequently, the rolled-paper sheet 4 is conveyed toward the registration roller 11. At this time, the pre-transfer roller motor RM and the fixing motor TM are turned on. Further, the pre-transfer clutch 80, the heat clutch 83 and the pressure clutch 84 are turned on, so that the pre-transfer roller 12 and the fixing roller 58 are driven.

When the conveyed rolled-paper sheet 4 reaches the registration switch 10, the registration switch 10 is turned on ($t_2$). The CPU 70 turns off the conveying clutch 81 and the registration clutch 82 after an elapse of a time period ($t_3$) required for the leading end of the rolled-paper sheet 4 to reach a nip position of the registration roller 11 after an on signal is inputted from the registration switch 10. As a result, the rolled-paper sheet 4 is stopped in a state where the leading end thereof abuts against the nip position of the registration roller 11. The registration clutch 82 is turned on at timing ($t_4$) at which the leading end of a toner image formed on the photosensitive drum 13 and the leading end of the rolled-paper sheet 4 coincide with each other in the position of the transferring corona discharger 42, so that the conveyance of the rolled-paper sheet 4 is resumed. At this time, the CPU 70 controls the pre-transfer roller motor RM on the basis of the pulse signal from the speed detector 86, so that the peripheral speeds of the conveying roller 8, the registration roller 11, the pre-transfer roller 12 and the fixing roller 58 are made equal to the peripheral speed of the photosensitive drum 13.

The rolled-paper sheet 4 whose conveyance is resumed by the registration roller 11 reaches the photosensitive drum 13 through the pre-transfer roller 12. At this time, the rolled-paper sheet 4 is so conveyed as to be pushed out by the pre-transfer roller 12, so that the toner image formed on the photosensitive drum 13 is successively transferred, starting at its leading end portion. The rolled-paper sheet 4 after the transfer enters the fixing roller 58 along the conveying path 44, to turn the fixing switch 48 on ($t_5$). The CPU 70 starts the peripheral speed control which characterizes the copying machine in response to the turning-on of the fixing switch 48.

In the peripheral speed control, the CPU 70 makes the peripheral speed of the pre-transfer roller 12 lower than the peripheral speed of the photosensitive drum 13 with reference to the output of the speed detector 86. That is, only the peripheral speed of the pre-transfer roller 12 is made lower than the peripheral speed of the photosensitive drum 13 with the peripheral speed of the fixing roller 58 made equal to the peripheral speed of the photosensitive drum 13. At this time, the conveying speed of the rolled-paper sheet 4 depends on the rotation of the fixing roller 58 because the pre-transfer clutch 80 is a clutch so adapted that slip occurs in one direction in a frictional portion in its inside when not less than a predetermined load occurs. Specifically, the conveying speed of the rolled-paper sheet 4 coincides with the peripheral speed of the photosensitive drum 13. Therefore, there arises no problem that the equal magnification of an image changes, for example, an image transferred to the rolled-paper sheet 4 extends.

Furthermore, predetermined tension is exerted on the rolled-paper sheet 4 in the vicinity of the photosensitive drum 13 due to the difference in the peripheral speed between the fixing roller 58 and the pre-transfer roller 12. Therefore, the rolled-paper sheet 4 is not wrinkled.

In a state where the peripheral speed control is carried out, the CPU 70 turns on a cutter motor KM and the cutter clutch 85 at predetermined timing ($t_6$). Consequently, the rotating blade 24 is driven, so that the rolled-paper sheet 4 is cut to predetermined lengths. The conveying clutch 81 is turned off ($t_7$) in response to the termination of the driving of the rotating blade 24. Thereafter, when a rear end portion of the cut rolled-paper sheet 4 reaches the registration switch 10, and an off signal is inputted to the CPU 70 from the registration switch 10, the peripheral speed of the pre-transfer roller 12 is brought into the original state, that is, is made equal to the peripheral speed of the photosensitive drum 13, whereby the peripheral speed control is terminated ($t_8$).

The peripheral speed control is thus terminated before the trailing end of the rolled-paper sheet 4 reaches the pre-transfer roller 12. For example, when the trailing end of the rolled-paper sheet 4 is separated from the pre-transfer roller 12 in a state where the peripheral speed of the pre-transfer roller 12 is made low, the tension exerted on the rolled-paper sheet 4 is suddenly removed. At this time, an image has been already transferred to a halfway portion of the rolled-paper sheet 4, whereby the transferred image on the rolled-paper sheet 4 is shifted by the change in the tension. Therefore, the peripheral speed control is terminated a little before the trailing end of the rolled-paper sheet 4 reaches the pre-transfer roller 12, and the peripheral speed of the pre-transfer roller 12 is returned to the same peripheral speed as that of the photosensitive drum 13, whereby the tension applied on the rolled-paper sheet 4 is slacken, to prevent the shift in transfer.

The trailing end of the rolled-paper sheet 4 turns the fixing switch 48 off ($t_g$) upon continuation of the conveyance, so that the rolled-paper sheet 4 is discharged into the outside of the copying machine by the discharge roller 49.

As described in the foregoing, the peripheral speed control for making the peripheral speed of the pre-transfer roller 12 lower than the peripheral speed of the photosensitive drum 13 is carried out in response to the turning-on of the fixing switch 48, that is, the arrival of rolled-paper sheet 4 at the fixing roller 58. In the peripheral speed control, the peripheral speed of the fixing roller 58 is not changed, whereby the conveying speed of the rolled-paper sheet 4 is not changed. Accordingly, there arises no problem that the equal magnification of an image changes, for example, an image transferred to the rolled-paper sheet 4 extends.

Predetermined tension is exerted on the rolled-paper sheet 4 while the peripheral speed control is carried out, whereby the rolled-paper sheet 4 is not wrinkled. Consequently, the rolled-paper sheet 4 is not jammed.

Furthermore, the peripheral speed of the pre-transfer roller 12 is returned to the same peripheral speed as that of the photosensitive drum 13 a little before the trailing end of the rolled-paper sheet 4 reaches the fixing roller 58. Consequently, it is possible to prevent the shift in the transferred image due to the change in the tension exerted on the rolled-paper sheet 4 which occurs when the rolled-paper sheet 4 is separated from the pre-transfer roller 12.

Although the embodiment of the present invention was described, the present invention is not limited to the above-mentioned embodiment. Although in the above-mentioned embodiment, the image recording apparatus is described by taking up only the copying machine, the image recording apparatus may be an image forming apparatus such as a printer, for example, in addition to the copying machine.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. An image recording apparatus comprising:

a conveying path for guiding a paper sheet;

a rotating drum provided in a predetermined position on the conveying path and rotated at a predetermined peripheral speed, an image to be transferred being formed thereon;

a pre-transfer roller provided on the upstream side of the rotating drum in a direction of paper conveyance on the conveying path and rotated at the same peripheral speed as the peripheral speed of the rotating drum in order to convey the paper sheet to the rotating drum, a fixing roller provided on the downstream side of the rotating drum in the direction of paper conveyance on the conveying path and rotated at the same peripheral speed as the peripheral speed of the rotating drum in order to convey the paper sheet and fix to the paper sheet the image transferred to the paper sheet; and peripheral speed control means for controlling the pre-transfer roller so that the peripheral speed of the pre-transfer roller is lower than the peripheral speed of the rotating drum over a predetermined time period after a leading end of the paper sheet reaches the fixing roller when the image is transferred to the paper sheet the length of which is longer than the distance of the conveying path from the pre-transfer roller to the fixing roller, and wherein said predetermined time period is a time period elapsed from the time when the leading end of the paper sheet reaches the fixing roller until a trailing end of the paper sheet reaches a predetermined positional relationship with the pre-transfer roller.

2. The image recording apparatus according to claim 1, wherein said predetermined time period is a time period elapsed until the trailing end of the paper sheet reaches a predetermined position on the upstream side of the pre-transfer roller.

3. The image recording apparatus according to claim 2, wherein a registration switch for detecting the paper sheet is provided on the upstream side of the pre-transfer roller in the direction of paper conveyance on the conveying path, the peripheral speed of the pre-transfer roller being switched on the basis of an output of the registration switch.

4. The image recording apparatus according to claim 3 wherein the peripheral speed of the pre-transfer roller is switched, on the basis of the output of the registration switch, to a speed that is equal to that of said rotating drum.

5. The image recording apparatus according to claim 1, wherein a fixing switch for detecting that the leading end of the paper sheet reaches the fixing roller is provided in relation to the fixing roller, the peripheral speed of the pre-transfer roller being switched on the basis of a signal of the fixing switch.

6. The image recording apparatus according to claim 1, wherein the pre-transfer roller comprises a clutch mechanism causing slip in rotation when not less than a predetermined load occurs in the direction of paper conveyance.

7. The image recording apparatus according to claim 1, comprising a plurality of rolled-papers respectively wound around a plurality of feeding reels, any one of the rolled-papers being selectively delivered to the conveying path as a paper sheet.

8. The image recording apparatus according to claim 7, wherein a cutter mechanism for cutting the rolled-paper is provided on the upstream side of the pre-transfer roller in the direction of paper conveyance on the conveying path.

9. The image recording apparatus according to claim 8, comprising a copying machine comprising a reading mechanism for reading an original and a mechanism for forming an image of the read original on a photosensitive drum.

10. The image recording apparatus according to claim 9, comprising a first motor for driving the pre-transfer roller and a second motor for driving the fixing roller, a speed detector for detecting the rotational speed of the pre-transfer roller being provided in relation to the pre-transfer roller, the rotational speed of the first motor being controlled on the basis of an output of the speed detector.

11. The image recording apparatus according to claim 10, wherein a driving force is applied to the cutter mechanism from the second motor.

12. The image recording apparatus according to claim 1 wherein said peripheral speed control means maintains the peripheral speed of said rotating drum equal to a peripheral speed of said fixing roller during the predetermined time period in which the peripheral speed of the pre-transfer roller is lower.

* * * * *